US005340324A

United States Patent [19]

Fields et al.

[11] Patent Number: 5,340,324

[45] Date of Patent: Aug. 23, 1994

[54] PHONE JACK LOCK

[76] Inventors: James H. Fields, 207 Verbena Dr., Palo Alto, Calif. 94303; Roberta B. Williams, 427 Grand Blvd., Half Moon Bay, Calif. 94019; C. L. McKinney, 1450 Maple St., Redwood City, Calif. 94063

[21] Appl. No.: 36,190

[22] Filed: Mar. 23, 1993

[51] Int. Cl.[5] ..... E05B 73/00; H01R 13/44

[52] U.S. Cl. ..... 439/133; 70/57; 70/DIG. 72

[58] Field of Search ..... 439/133, 304; 70/57, 70/DIG. 72; 379/438, 445

[56] References Cited

U.S. PATENT DOCUMENTS 4,311,883 1/1982 Kidney ..... 70/DIG. 72

4,893,488 1/1990 Klein ..... 70/57

5,190,466 3/1993 McVey ..... 439/133

*Primary Examiner*—Neil Abrams

*Attorney, Agent, or Firm*—Keith Kline

[57] ABSTRACT

A phone jack lock that is molded to the contours of a standard phone jack. When the lock is installed, a spring-loaded locking element protrudes behind the outer surface of the phone jack so that the lock cannot be removed without the key. All elements of the lock are contained within the contours of the interior of the phone jack, so that no element extends beyond the external surface of the jack when the lock is in place, i.e., the locked jack has the same profile as the unlocked jack. The lock may be used without installation effort or tools.

4 Claims, 6 Drawing Sheets

PHONE JACK LOCK

FIELD OF THE INVENTION

This invention relates generally to telephone peripheral equipment, and more specifically, the present invention is a security device to prevent access to a telephone outlet jack.

BACKGROUND OF THE INVENTION

Modern telephones are completely modular in design. Installing a phone in nearly all cases is simply a matter of plugging the phone into an existing wall jack.

One of the problems inherent in such a convenient arrangement is that unauthorized persons can easily use a phone jack that is in service at the time. Having the phone company discontinue service to a given jack is both expensive and time consuming. Accordingly, there have been many devices patented to protect an active jack from unauthorized users.

"Telephone Lock" by McDaid, U.S. Pat. No. 4,964,284, discloses a device which has a plug portion which blocks the jack from unauthorized use. McDaid has the locking mechanism external to the phone jack.

"Modular Telephone Jack Lock" by Kidney, U.S. Pat. No. 4,311,883, discloses another device with a locking plug. Kidney also has an external locking mechanism and includes means for securing the phone itself.

Another McDaid device, U.S. Pat. No. 5,119,419, provides a means for securing a phone in a jack, but does not appear to disclose a means to secure an unused jack.

There are also several devices which do not actually plug the jack, but rather are attached to the wall near the jack, then physically cover the jack in a lockable manner. The "Locking Device for Telephone Subscriber Plugs" by Carney, et al., U.S. Pat. No. 4,740,168; the "Jack Security Device" of Marson, et al., U.S. Pat. No. 4,911,646; and the "Security Cover" of Petersdorff, etal., U.S. Pat. No. 4,584,856; are all examples of the covering type of device utilized to secure an active wall jack.

One shortcoming of the prior art is that all of the devices utilize hardware that is external to the jack itself. In areas where space or aesthetics is a consideration, this may not be acceptable.

Another problem that exists in the prior art is that the devices require significant effort to install, or the devices are complex enough and require sufficient hardware so that manufacturing costs are prohibitively high.

SUMMARY OF THE INVENTION

Accordingly, it is an object of the present invention to provide a device that secures a telephone jack and can be manufactured at low cost.

A further object of the present invention is to provide a phone jack lock that does not protrude from the wall in which the jack is installed.

The present invention is a phone jack lock that is molded to the contours of a standard phone jack. When the lock is installed, a spring-loaded locking element protrudes behind the outer surface of the phone jack so that the lock cannot be removed without the key. All elements of the lock are contained within the contours of the interior of the phone jack, so that no element extends beyond the external surface of the jack when the lock is in place, i.e., the locked jack has the same profile as the unlocked jack.

An advantage of the present invention is that the lock may be used without installation effort or tools.

Another advantage of the present invention is that it has very few components and is therefore easy and inexpensive to manufacture.

A further advantage of the present invention is that it has no elements which protrude beyond the surface of the wall in which the jack is installed.

BEST MODE OF CARRYING OUT THE INVENTION

Figure 1:
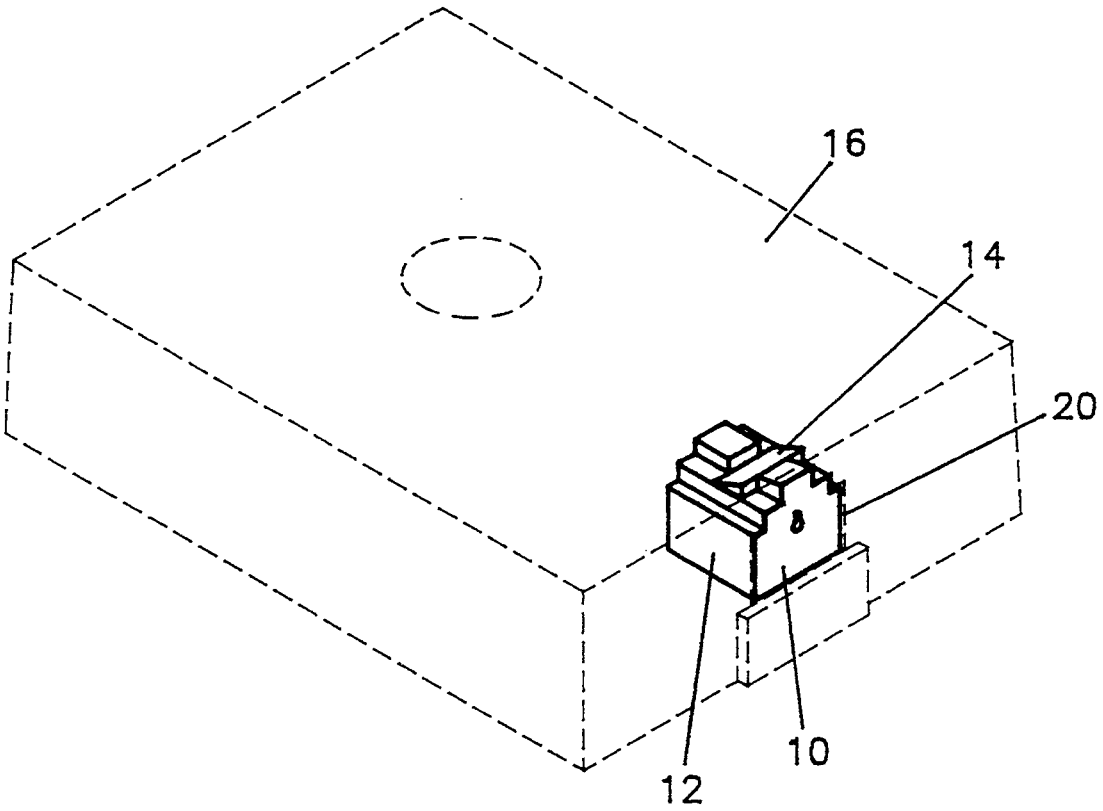
FIG. 1 is a perspective view of the phone jack lock of the present invention in the locked position.
Figure 1A:
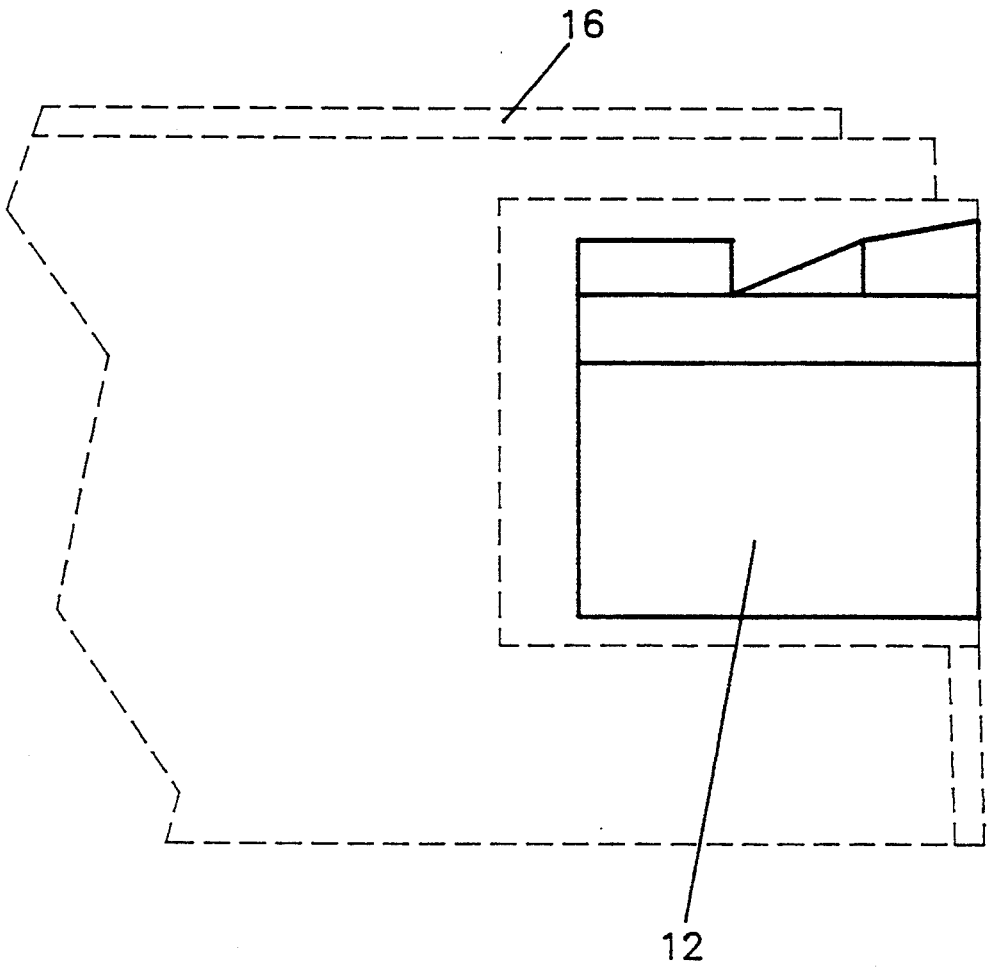
FIG. 1A is a side view of the phone jack lock of the present invention in the locked position.

Referring first to FIG. 1, illustrating the preferred embodiment of the present invention, a phone jack lock 10 includes a plug body 12 and a locking element 14. The plug body 12 is molded to conform to the shape of the interior of a standard phone jack 16. No element of the lock 10 extends beyond the outer surface of the jack 16.

A key 18 is required to retract the locking element 14 to allow the lock 10 to be removed from the jack 16. When in use to restrict access to an active phone jack, the locking element 14 extends beyond the inner edge of a jack inlet 20, making it impossible to pull the lock 10 out of the jack 16.

A spring 22 (shown in FIG. 3) exerts constant pressure on the locking element 14 urging the locking element 14 toward its raised and locked position. However, due to a tapered surface 24 at the upper end of the locking element 14, the key is not required to insert the lock 10 into a jack 16.

When the lock is inserted into a jack inlet 20, a lower end 26 of the tapered surface 24 of the locking element 14 first contacts the outer edge of the inlet 20. As the user pushes the lock 10 into the inlet 20, the tapered surface 24 of the locking element moves along the rigid inlet 20, driving the locking element toward a retracted position. (The retracted position of the lock 10 is shown in FIG. 2.)

As the lock is fully inserted into the jack inlet 20, the locking element 14 passes behind the inner edge of the inlet 20. Once the locking element clears that inner edge, the force exerted by the spring 22 causes the locking element 14 to raise to its locked position behind the inner surface of the inlet 20. If someone attempts to remove the lock without a key, an upper end 28 of the tapered surface 24 of the locking element 14 contacts the inner surface of the jack inlet 20, and prohibits the lock's removal.

Figure 2:
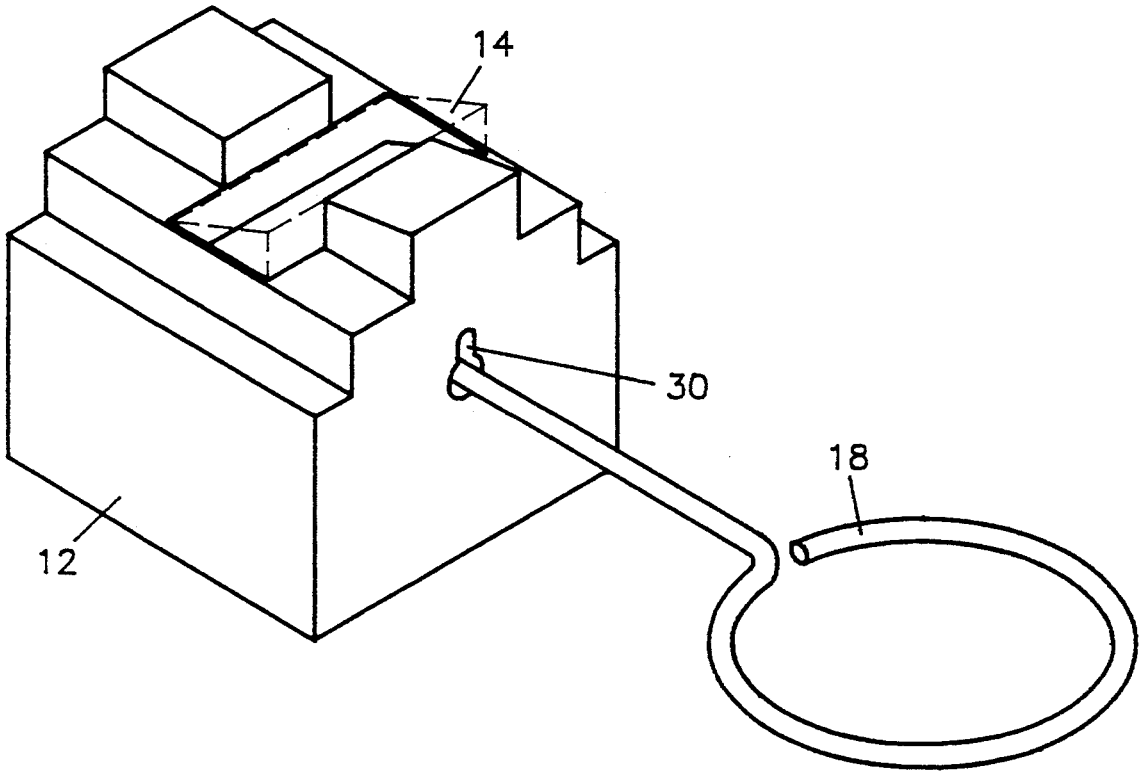
FIG. 2 is a perspective view of the phone jack lock in the unlocked position.
Figure 3:
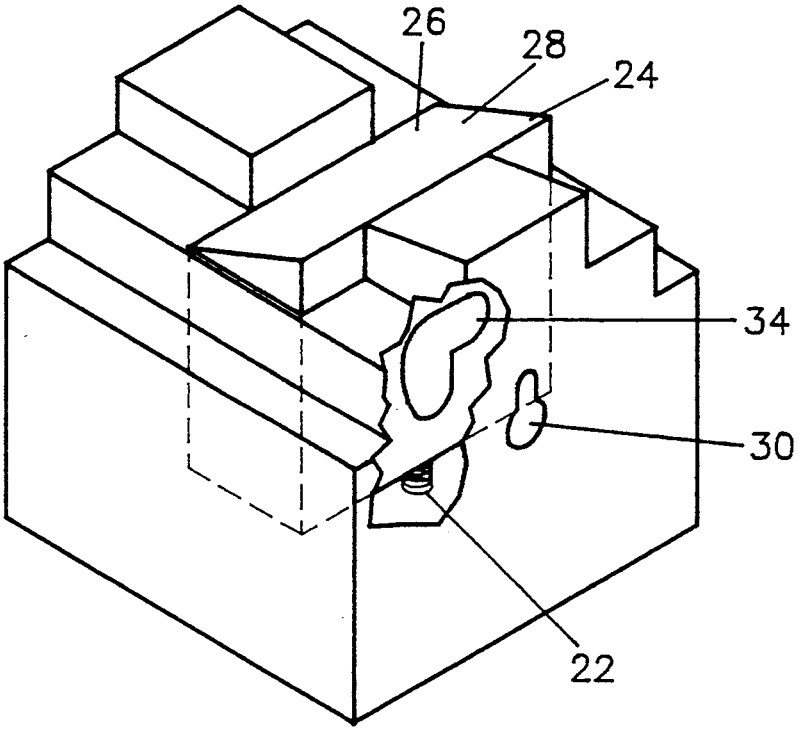
FIG. 3 is a cutaway perspective view of the device.

To remove the lock 10, the locking element 14 must be moved to the retracted position shown in FIG. 2. The user inserts the key 18 into a keyhole 30 and rotates the key. This causes an angled segment 32 of the key 18 to turn inside a tumbler aperture 34 in the locking element 14. (These elements are illustrated in FIG. 3.) As the key is turned, the shape of the tumbler aperture 34 causes a downward force to be generated on the locking element.

The downward force thus generated by the turning of the key 18 overcomes the tension applied by the spring 22, and moves the locking element to the retracted position. The user can then remove the lock from the jack 16, and plug in a phone if he so desires.

FIRST ALTERNATE EMBODIMENT

Figure 4:
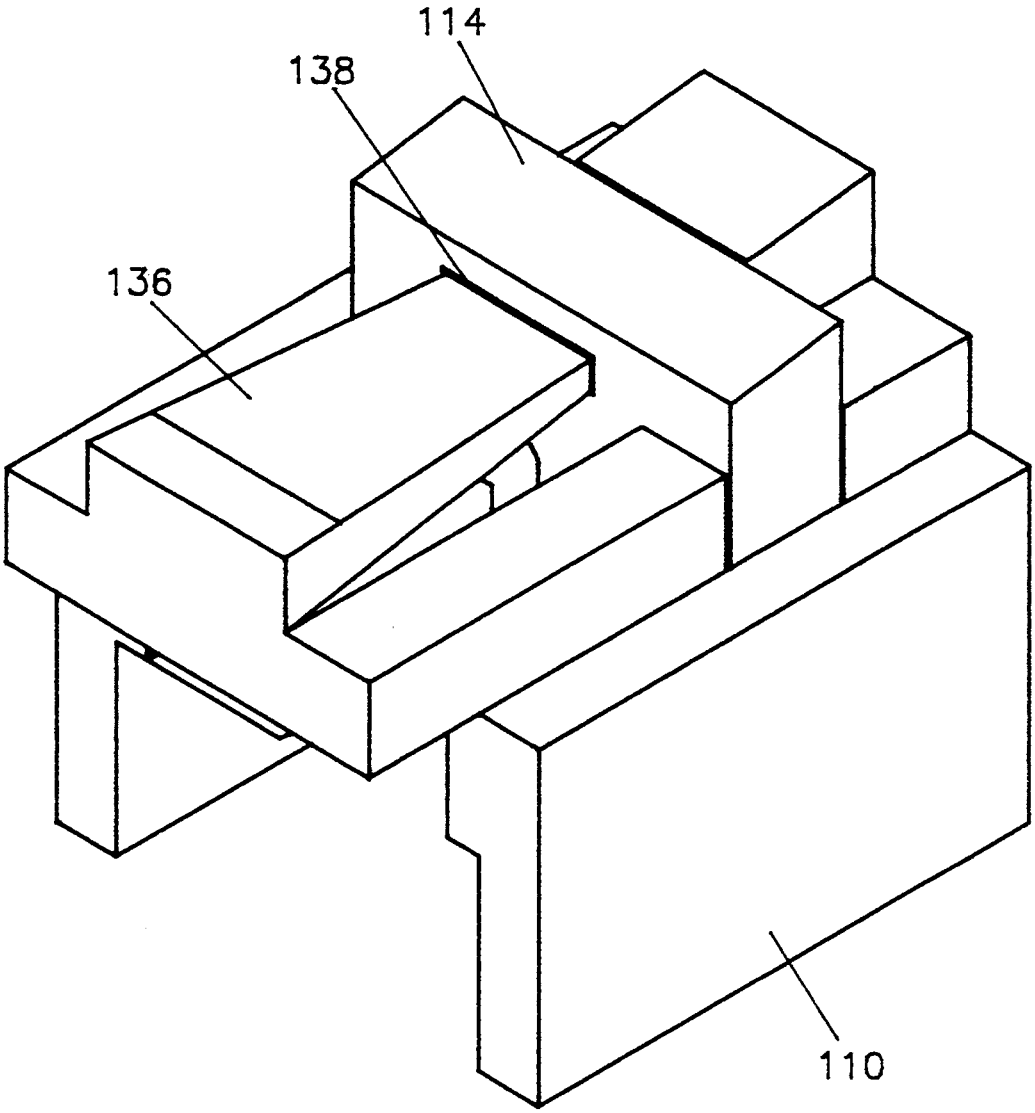
FIG. 4 is an elevated rear perspective of a first alternate embodiment of the device.

A first alternate embodiment 110 of the phone jack lock 10 is shown in FIG. 4. Elements common to both embodiments bear equivalent designating numerals differing by 100, e.g. element 12 of the preferred embodiment is designated as element 112 in the first alternate embodiment. The first alternate embodiment lock 110 differs from the preferred embodiment 10 chiefly in its locking mechanism.

The locking element 114 includes on its rear surface a slotted aperture 138. A raised, flexible prong 136 is affixed to the top of the rear of the lock plug body 112. When, either by use of the key or when being inserted into the phone jack, the locking element 114 is lowered, the prong 136 is bent downward.

The prong 136 thus exerts an upward pressure on the locking element 114, and replaces the function of the spring 22 utilized in the preferred embodiment. When the pressure on the key is released, or the locking element passes the inner edge of the phone jack, locking element 114 is raised by the pressure from the prong 136 to the locked position.

SECOND ALTERNATE EMBODIMENT

Figure 5:
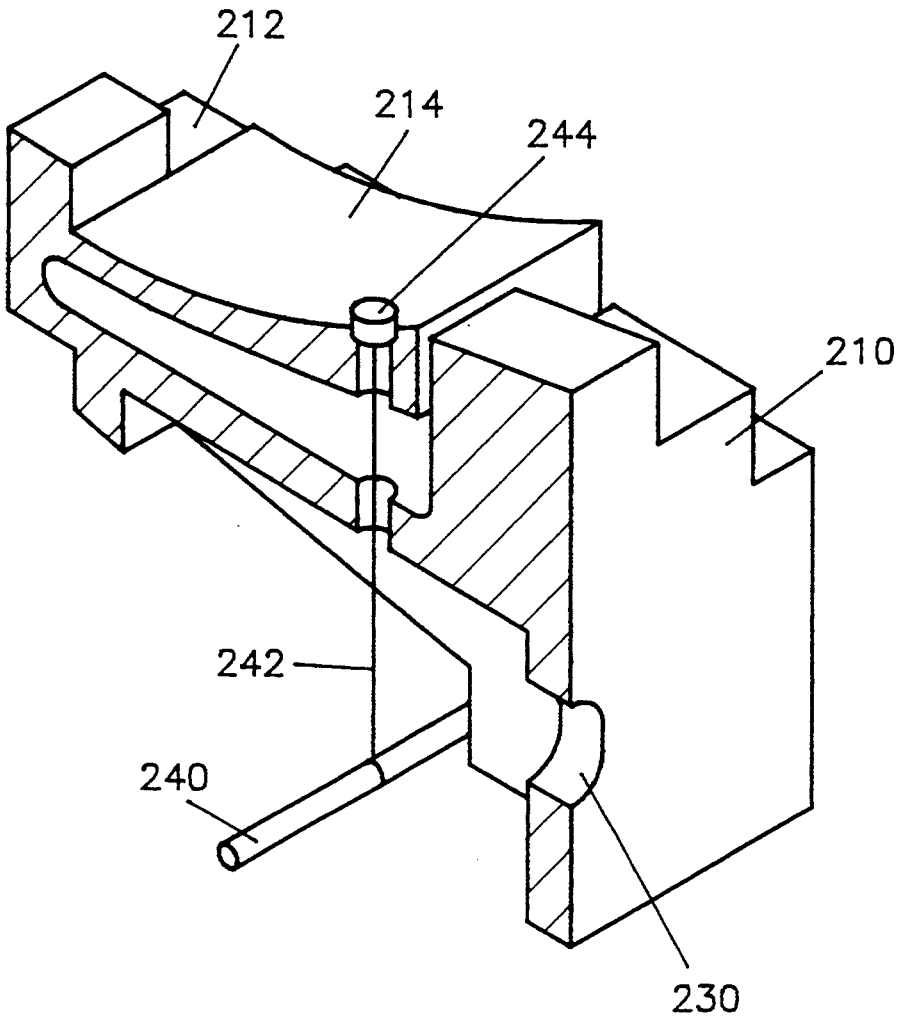
FIG. 5 is an elevated rear perspective of a second alternate embodiment of the device of the present invention.

A second alternate embodiment 210 of the phone jack lock 10 is shown in FIG. 5. Elements common to both embodiments bear equivalent designating numerals differing by 200, e.g. element 12 of the preferred embodiment is designated as element 212 in the second alternate embodiment. The second alternate embodiment lock 210, as the first alternate embodiment, differs from the preferred embodiment 10 chiefly in its locking mechanism.

In the second alternate embodiment 210, the locking element is a curved or tapered element extending from and integral to the top of the rear of the lock body 212.

In this embodiment, the spring force urging the locking element 214 toward its locked position is created by the flexibility of the material used for that element. The locking element 214 is retracted either by contact with the phone jack, or by applying a lowering force with the key.

The key for the second alternate embodiment is shaped so that the user can apply force to a cable 242 affixed by a securing means 244 to the locking element 214. It is envisioned that the key will simply be formed with a hook in its end capable of encircling the cable 242.

To remove an installed lock 214 from a jack, the user will insert the key into the keyhole 230, secure the cable 242, and pull the key toward the user. This will retract the locking element 214, and allow the lock 210 to be removed.

The above disclosure is not intended as limiting. Those skilled in the art will readily observe that numerous modifications and alterations of the device may be made while retaining the teachings of the invention. Accordingly, the above disclosure should be construed as limited only by the metes and bounds of the appended claims.

We claim:

1. A phone jack lock comprising:

a plug body, a locking element, means to apply a constant force to the locking element which force urges the locking element to remain in the locked position, and means to lock and unlock the phone jack lock; wherein the lock may be inserted into a phone jack without use of the locking/unlocking means, the constant force on the locking element being overcome by contact with the phone jack, thus depressing the locking element; and once inserted into a phone jack in the locked position, the locking element protrudes such that the lock may not be removed from the jack without use of the locking/unlocking means, wherein the entire locking device, when inserted into a phone jack, is completely contained within the contours of the phone jack.

2. The phone jack lock as claimed in claim 1 wherein: the constant force on the locking element is provided by a spring.

3. The phone jack lock as claimed in claim 1 wherein: the constant force on the locking element is provided by a prong flexible inserted into a slot in the rear of the locking element.

4. The phone jack lock as claimed in claim 1 wherein: the constant force on the locking element is provided by an integral connection of the locking element with the rear of the plug body.

* * * * *